US011649606B2

(12) United States Patent
Stolz

(10) Patent No.: US 11,649,606 B2
(45) Date of Patent: May 16, 2023

(54) DRAGLINE BUCKET

(71) Applicant: Caterpillar Inc., Peoria, IL (US)

(72) Inventor: Michael Robert Stolz, Franklin, WI (US)

(73) Assignee: Caterpillar Inc., Peoria, IL (US)

( * ) Notice: Subject to any disclaimer, the term of this patent is extended or adjusted under 35 U.S.C. 154(b) by 234 days.

(21) Appl. No.: 16/906,155

(22) Filed: Jun. 19, 2020

(65) Prior Publication Data

US 2021/0395973 A1 Dec. 23, 2021

(51) Int. Cl.
*E02F 3/60* (2006.01)
*E02F 3/48* (2006.01)

(52) U.S. Cl.
CPC . *E02F 3/60* (2013.01); *E02F 3/48* (2013.01)

(58) Field of Classification Search
CPC ..... E02F 3/34; E02F 3/40; E02F 3/28; E02F 3/60
See application file for complete search history.

(56) References Cited

U.S. PATENT DOCUMENTS 946,899 A * 1/1910 Hayward ..... E02F 3/48 37/395
1,306,873 A * 6/1919 Wood ..... E02F 3/60 37/396
1,524,096 A * 1/1925 Green ..... E02F 3/60 172/26.5
2,669,042 A * 2/1954 Swank ..... E02F 3/60 37/398
3,531,088 A * 9/1970 Kraschnewski ..... E02F 3/48 254/292
3,556,317 A * 1/1971 Vidal ..... E02F 3/48 414/133
6,834,449 B2 12/2004 Leslie et al.
7,774,959 B2 8/2010 Kubo et al.
9,982,412 B1 * 5/2018 Stolz ..... E02F 3/48
10,422,103 B2 9/2019 Leslie et al.
10,544,562 B2 * 1/2020 Stolz ..... E02F 3/48
2006/0107556 A1 5/2006 Rowlands

FOREIGN PATENT DOCUMENTS

AU 2008202822 7/2014
RU 39147 7/2004

* cited by examiner

*Primary Examiner* — Jessica H Lutz
(74) *Attorney, Agent, or Firm* — von Briesen & Roper, s.c.

(57) ABSTRACT

A dragline bucket includes a base member defining a first end, a second end, and a third end. The dragline bucket also includes a first side wall, a second side wall, and an end wall extending from the base member proximate to the third end of the base member such that the end wall is connected to each of the first side wall and the second side wall. The end wall includes a first portion connected to the base member such that a first angle is defined between the base member and the first portion. The end wall also includes a second portion extending from the first portion. The second portion is substantially perpendicular to the base member. The end wall further includes a third portion extending from the second portion such that a second angle is defined between the second portion and the first portion.

24 Claims, 5 Drawing Sheets

DRAGLINE BUCKET

TECHNICAL FIELD

The present disclosure relates to a dragline bucket and a machine including the dragline bucket.

BACKGROUND

Machines, such as dragline excavators, typically include a dragline bucket associated therewith. The dragline bucket may be used in mining and earth moving operations. For example, the dragline bucket may be used to capture materials such as rocks/aggregate, or other large finds. The dragline bucket is suspended from a boom of the machine by a rigging assembly. The dragline bucket is maneuvered by means of the rigging assembly.

An amount of material that can be carried by the dragline bucket is typically governed by a volume of the dragline bucket. Further, the volume of the dragline bucket may vary based on a shape of the dragline bucket. Conventionally, the dragline bucket includes a pair of side walls, a base member, and an end wall/rear wall. The end wall of the bucket is generally curved. Such a curved profile of the end wall may reduce the volume of the dragline bucket. Reduction in the volume may in turn reduce a productivity at a worksite as the conventional dragline bucket may hold reduced amount of material therein, which is not desirable.

U.S. Pat. No. 10,544,562 describes a dragline bucket including a base member. A first side member extends from the base member. The dragline bucket further includes a first top edge. A second side member extends from the base member. Further, a rear member extends from the base member. Further, the dragline bucket includes a second top edge, a mouth for receiving material into the bucket. The dragline bucket includes a first beveled wall extending from the first side member forming a first compound angle with the base member. Moreover, a second beveled wall extends from the rear member proximate the first beveled wall forming a second compound angle with the base member.

SUMMARY

In an aspect of the present disclosure, a dragline bucket is provided. The dragline bucket includes a base member defining a first end, a second end, and a third end. The dragline bucket also includes a first side wall extending from the base member proximate to the first end of the base member. The first side wall defines a first edge that is distal to the base member. The dragline bucket further includes a second side wall extending from the base member proximate to the second end of the base member. The first side wall is laterally spaced apart from the second side wall. The second side wall defines a second edge that is distal to the base member. The dragline bucket includes an end wall extending from the base member proximate to the third end of the base member such that the end wall is connected to each of the first side wall and the second side wall. The base member, the first side wall, the second side wall, and the end wall define a material receiving portion of the dragline bucket. The end wall includes a first portion connected to the base member. The first portion is disposed such that a first angle is defined between the base member and the first portion. The end wall also includes a second portion extending from the first portion. The second portion is substantially perpendicular to the base member. The end wall further includes a third portion extending from the second portion such that the second portion is disposed between the first portion and the third portion. The third portion is disposed such that a second angle is defined between the second portion and the first portion.

In an aspect of the present disclosure a machine is provided. The machine includes a boom. The machine also includes a rigging assembly adapted to be coupled to the boom. The machine further includes a dragline bucket adapted to be coupled to the rigging assembly. The dragline bucket includes a base member defining a first end, a second end, and a third end. The dragline bucket also includes a first side wall extending from the base member proximate to the first end of the base member. The first side wall defines a first edge that is distal to the base member. The dragline bucket further includes a second side wall extending from the base member proximate to the second end of the base member. The first side wall is laterally spaced apart from the second side wall. The second side wall defines a second edge that is distal to the base member. The dragline bucket includes an end wall extending from the base member proximate to the third end of the base member such that the end wall is connected to each of the first side wall and the second side wall. The base member, the first side wall, the second side wall, and the end wall define a material receiving portion of the dragline bucket. The end wall includes a first portion connected to the base member. The first portion is disposed such that a first angle is defined between the base member and the first portion. The end wall also includes a second portion extending from the first portion. The second portion is substantially perpendicular to the base member. The end wall further includes a third portion extending from the second portion such that the second portion is disposed between the first portion and the third portion. The third portion is disposed such that a second angle is defined between the second portion and the first portion.

DETAILED DESCRIPTION

Wherever possible, the same reference numbers will be used throughout the drawings to refer to same or like parts.

Figure 1:
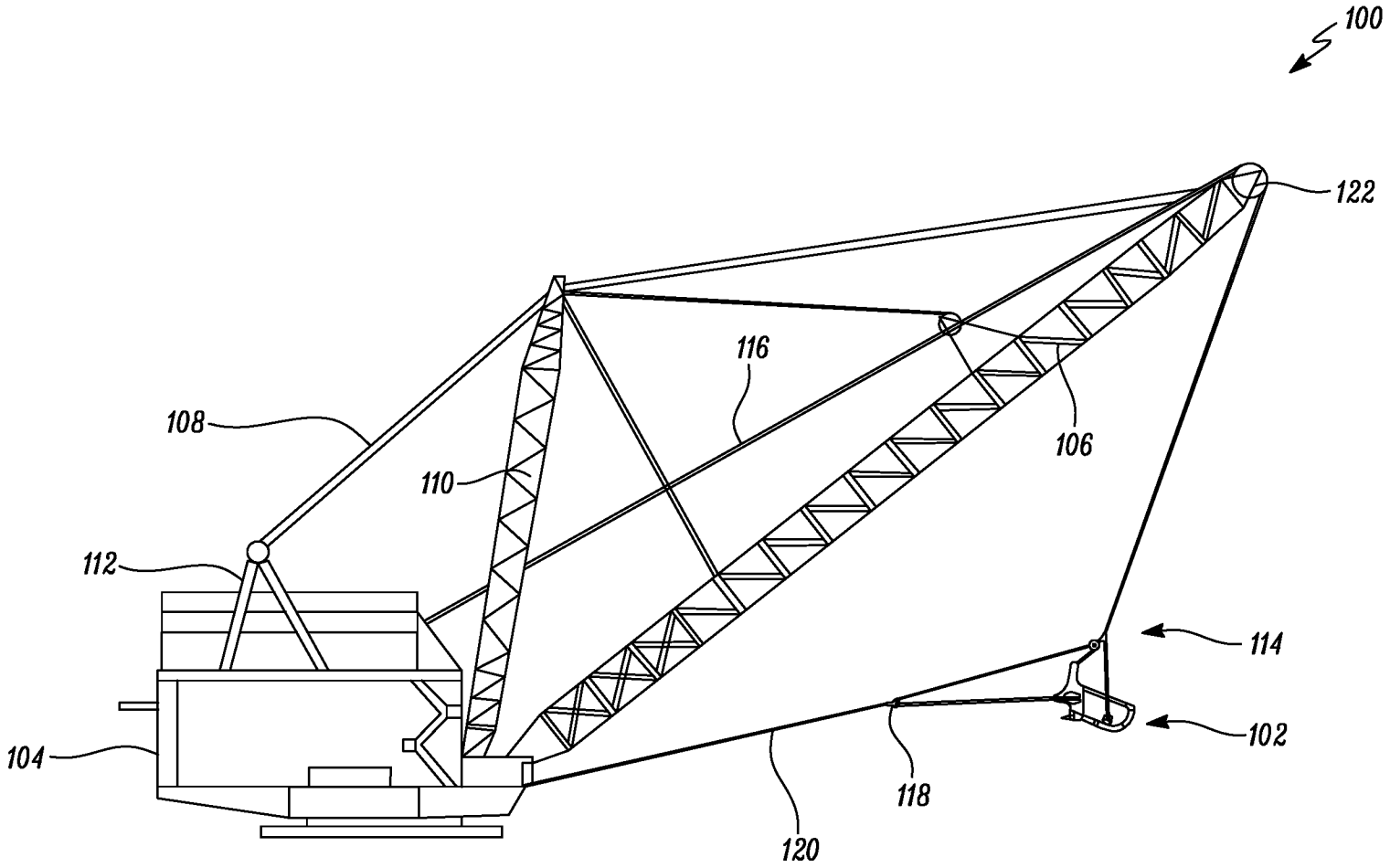
FIG. 1 illustrates a side view of a machine, in accordance with an embodiment of the present disclosure.

FIG. 1 illustrates an exemplary machine 100. The machine 100 is embodied as a dragline excavator herein. Alternatively, the machine 100 may include another type of earthmoving machine that employs a dragline bucket 102 that will be explained later in this section. The machine 100 may perform one or more operations associated with an industry such as mining, construction, forestry, farming, transportation, or any other industry known in the art. The machine 100 may be embodied as a manual, autonomous, or semi-autonomous machine, without any limitations.

The machine 100 includes a house 104. The machine 100 further includes a power source (not shown) supported by the house 104. The power source may supply power to various components of the machine 100 for operation, movement, and the like. In one example, the power source may include an engine, such as a diesel engine, a gasoline engine, a gaseous fuel-powered engine, or any other type of combustion engine known in the art. In other examples, the power source may include an electric drive assembly having an electric motor (not shown).

The machine 100 includes a boom 106. The boom 106 is controlled by a suspension system 108 connected to a mast 110 and a gantry frame 112. The machine 100 further includes a rigging assembly 114 coupled to one or more hoist ropes 116. Moreover, the machine 100 includes the dragline bucket 102 coupled to the rigging assembly 114. The rigging assembly 114 includes a drag socket 118 and one or more drag ropes 120. The hoist ropes 116 pass over a boom point sheave 122 of the boom 106 and suspends the dragline bucket 102 therefrom. Further, the dragline bucket 102 is coupled to the drag ropes 120 by the drag socket 118.

Figure 2:
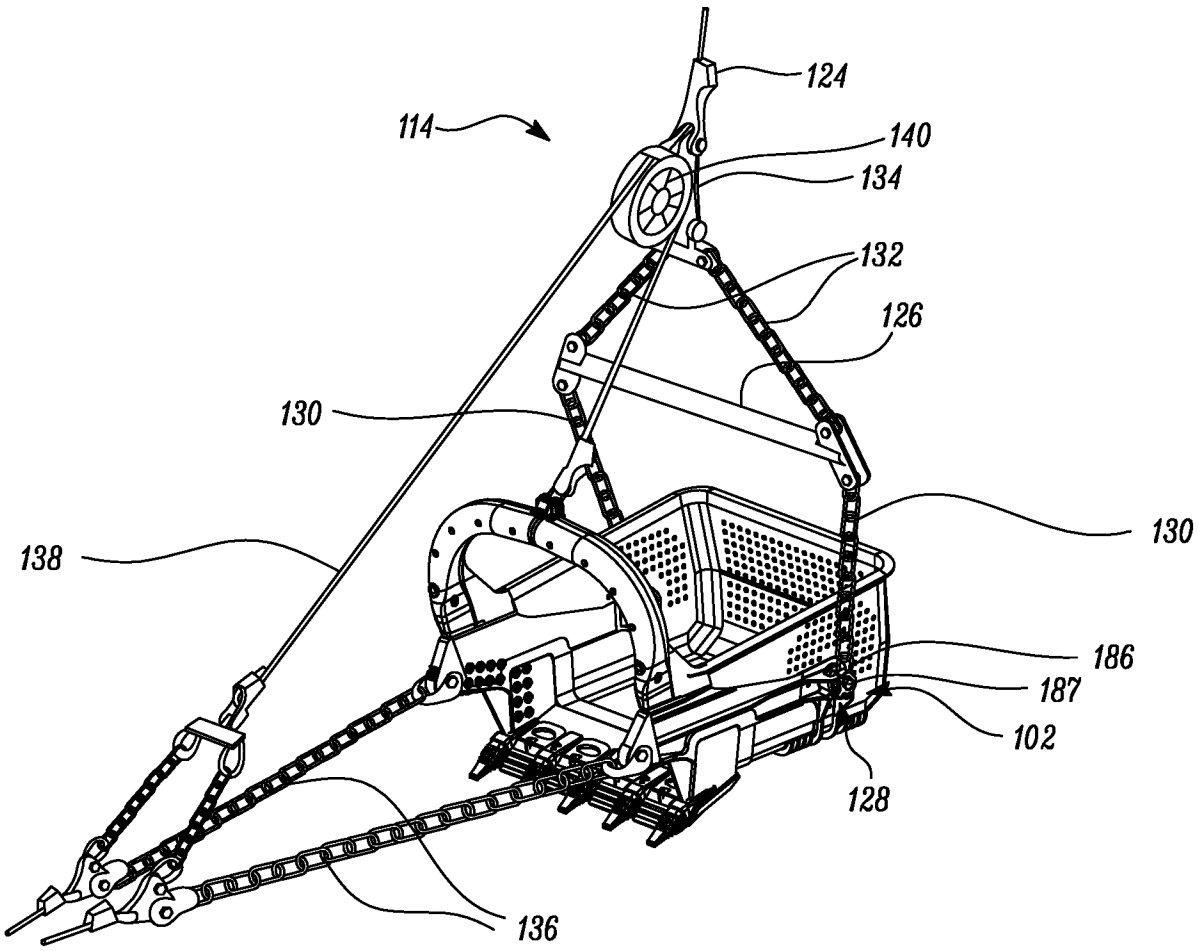
FIG. 2 illustrates a perspective view of a rigging assembly and a dragline bucket associated with the machine of FIG. 1, in accordance with an embodiment of the present disclosure.

FIG. 2 illustrates the rigging assembly 114 and the dragline bucket 102. As illustrated, the rigging assembly 114 includes a hoist socket 124 and a spreader bar 126. A link 186 is connected to a trunnion attachment structure 128 of the dragline bucket 102 by a pair of lower hoist chains 130. Further, a pair of upper hoist chains 132 are disposed between the spreader bar 126 and a bracket 134. The spreader bar 126 along with the lower and upper hoist chains 130, 132 suspends the dragline bucket 102. Further, the dragline bucket 102 can be moved by drag chains 136 and a dump rope 138 that is connected to the dragline bucket 102 by a dump sheave 140.

Figure 3:
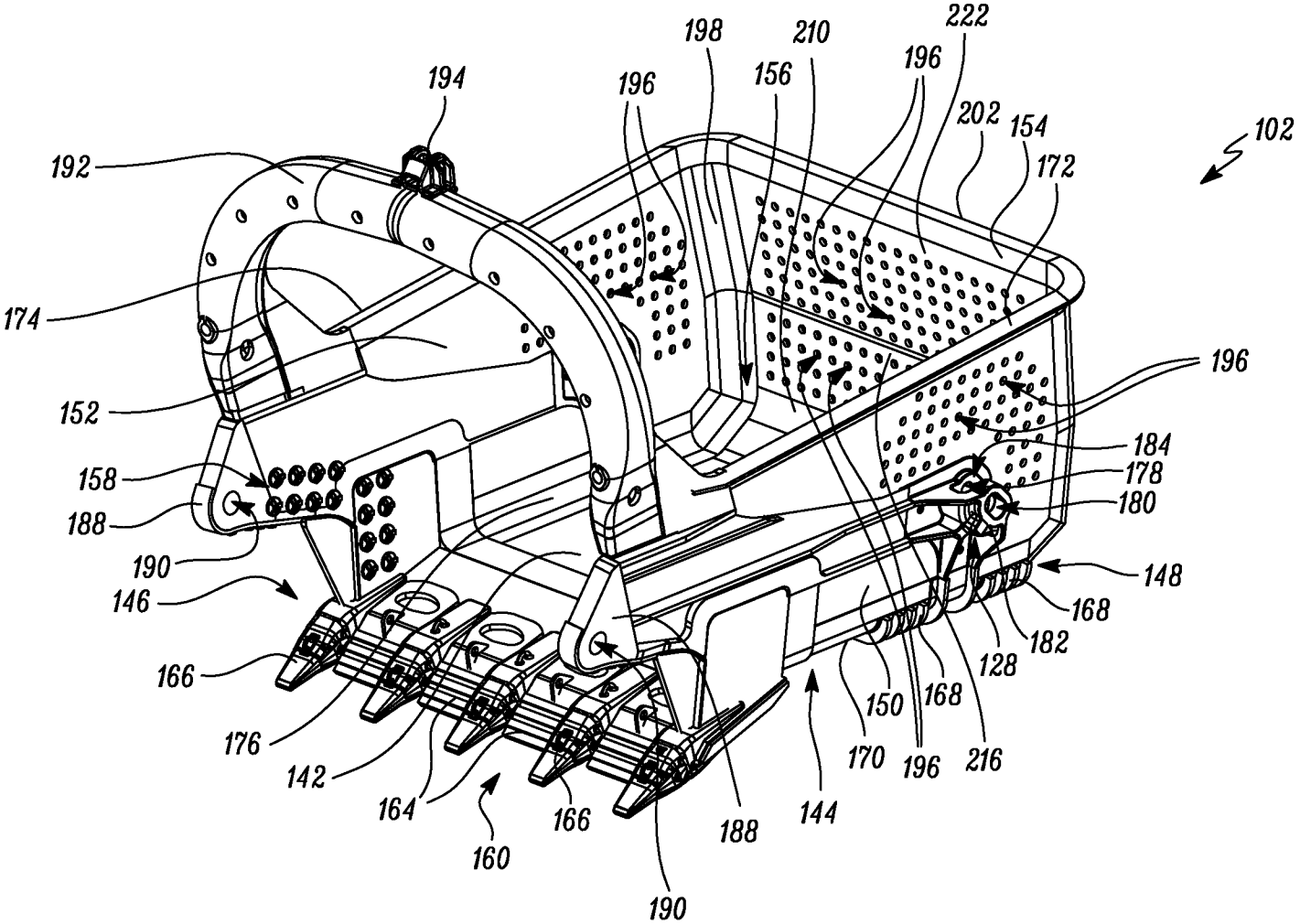
FIG. 3 illustrates a perspective view of the dragline bucket of FIG. 2.

FIG. 3 illustrates a perspective view of the dragline bucket 102. The dragline bucket 102 defines a first height "H1" (shown in FIG. 4). In the illustrated example, the first height "H1" is defined as an average height of the dragline bucket 102. Alternatively, the first height "H1" may be defined as a maximum height of the dragline bucket 102. The dragline bucket 102 includes a base member 142. The base member 142 defines a first end 144, a second end 146, and a third end 148. The dragline bucket 102 also includes a first side wall 150, a second side wall 152, and an end wall 154. The base member 142, the first side wall 150, the second side wall 152, and the end wall 154 define a material receiving portion 156 of the dragline bucket 102. The material receiving portion 156 is embodied as a hollow space for receiving material 157 (shown in FIG. 4) therein. Further, the first side wall 150, the second side wall 152, and the base member 142 define a mouth portion 158 for receiving the material 157 in the material receiving portion 156.

The base member 142 defines a fourth end 160 proximate to the mouth portion 158. The fourth end 160 of the base member 142 is covered by various devices such as edge protectors or shrouds 164 and ground engaging tools 166. The ground engaging tools 166 may be attached to the fourth end 160 using tool adapters (not shown). In other embodiments, the base member 142 may include a continuous edge protector proximate to the fourth end 160 of the base member 142. Alternatively, any form of protection proximate to the fourth end 160 may be omitted. Moreover, the base member 142 includes a number of wear bars 168. The wear bars 168 extend from a bottom surface 170 of the base member 142.

The dragline bucket 102 includes the first side wall 150 extending from the base member 142 proximate to the first end 144 of the base member 142. The first side wall 150 defines a first edge 172 that is distal to the base member 142. The first edge 172 is a top edge of the first side wall 150. Further, a curvature (not shown) is defined between the first side wall 150 and the base member 142. The dragline bucket 102 also includes the second side wall 152 extending from the base member 142 proximate to the second end 146 of the base member 142. The first side wall 150 is laterally spaced apart from the second side wall 152. The second side wall 152 defines a second edge 174 that is distal to the base member 142. The second edge 174 is a top edge of the second side wall 152. Further, a curvature 176 is defined between the second side wall 152 and the base member 142.

Further, each of the first side wall 150 and the second side wall 152 includes the trunnion attachment structure 128 disposed proximate to the end wall 154. The trunnion attachment structure 128 associated with the first side wall 150 is illustrated herein. However, it should be noted that the trunnion attachment structures 128 associated with each of the first and second side walls 150, 152 have a similar design. The trunnion attachment structure 128 is coupled with a portion (described as the lower hoist chains 130 shown in FIG. 2) of the rigging assembly 114. More particularly, the trunnion attachment structure 128 allows coupling of the dragline bucket 102 with the lower hoist chains 130. The trunnion attachment structure 128 includes an aperture 178 defined in the respective first and second side walls 150, 152 and an aperture 180 defined in a plate member 182 that is spaced apart from the respective first and second side walls 150, 152. Further, the trunnion attachment structure 128 defines a trunnion slot 184 between the respective first and second side walls 150, 152 and the plate member 182. The trunnion slot 184 receives the link 186 (see FIG. 2) associated with the lower hoist chains 130. Further, an aperture (not shown) in the link 186 aligns with the apertures 178, 180 to receive a pin 187 (shown in FIG. 2) therethrough for coupling the respective lower hoist chains 130 with the dragline bucket 102.

Moreover, each of the first and second side walls 150, 152 includes a bracket member 188. The bracket members 188 are disposed proximate to the mouth portion 158. The bracket members 188 define an opening 190 that allows connection of the dragline bucket 102 with the drag chains 136. Further, an arch portion 192 is disposed between the first side wall 150 and the second side wall 152. The arch portion 192 includes an attachment structure 194 that allows coupling of the dragline bucket 102 with the dump rope 138.

Further, each of the first side wall 150, the second side wall 152, and the end wall 154 defines a number of perforations 196. As illustrated, the perforations 196 in the first side wall 150 and the second side wall 152 are provided proximate to the end wall 154 of the base member 142. In some examples, the base member 142 may also include the perforations 196. When the dragline bucket 102 is used to excavate material 157 from water bodies, excess liquid contained in the dragline bucket 102 may drain out of the dragline bucket 102 via the perforations 196. In this embodiment, the perforations 196 are depicted as circular holes. In other embodiments, the perforations 196 may be embodied as slots. In some embodiments, the dragline bucket 102 may omit the perforations 196.

The dragline bucket 102 includes the end wall 154 extending from the base member 142 proximate to the third end 148 of the base member 142 such that the end wall 154 is connected to each of the first side wall 150 and the second side wall 152. As illustrated, a curvature 198 is defined between each of the first and second side walls 150, 152 and the end wall 154. The end wall 154 defines a third edge 200 proximate to the base member 142 and a fourth edge 202 distal to the base member 142. The fourth edge 202 is connected to each of the first edge 172 of the first side wall 150 and the second edge 174 of the second side wall 152.

Figure 4:
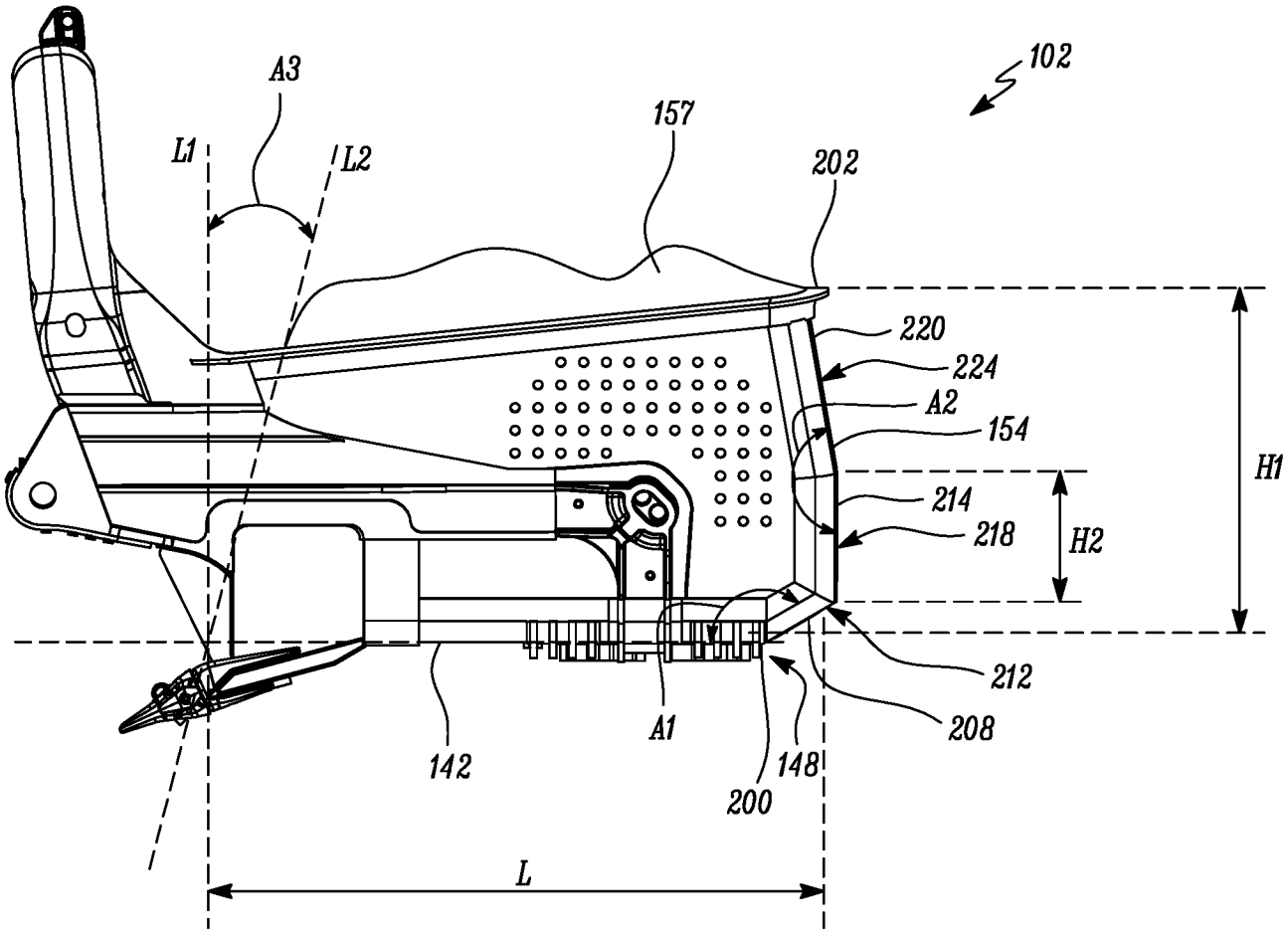
FIG. 4 illustrates a side view of the dragline bucket of FIG. 2.

FIG. 4 illustrates a side view of the dragline bucket 102. As illustrated herein, the end wall 154 includes a first portion 208 connected to the base member 142. The first portion 208 is disposed such that a first angle "A1" is defined between the first portion 208 and the base member 142. The first angle "A1" ranges from 130 degrees to 170 degrees. In some examples, the first angle "A1" ranges from 140 degrees to 150 degrees. The first portion 208 defines a first inner surface 210 (shown in FIG. 3) and a first outer surface 212. The first portion 208 defines the third edge 200 of the end wall 154 that is connected to a rear edge (not shown) of the base member 142 by a curvature (not shown). Although the first portion 208 described herein omits the perforations 196, in some examples, the first portion 208 may also include the perforations 196, without any limitations.

Further, the end wall 154 includes a second portion 214 extending from the first portion 208. The second portion 214 is substantially perpendicular to the base member 142. Further, the second portion 214 includes the perforations 196. The second portion 214 defines a second inner surface 216 (shown in FIG. 3) and a second outer surface 218. The second portion 214 defines a second height "H2". More particularly, the dragline bucket 102 defines the first height "H1" and the second portion 214 defines the second height "H2" such that the second height "H2" is approximately equal to 20% to 55% of the first height "H1". In some examples, the second height "H2" is approximately equal to 25% to 50% of the first height "H1".

Further, the end wall 154 includes a third portion 220 extending from the second portion 214 such that the second portion 214 is disposed between the first portion 208 and the third portion 220. The third portion 220 is disposed such that a second angle "A2" is defined between the second portion 214 and the third portion 220. The second angle "A2" ranges from 170 degrees to 180 degrees. In some examples, the second angle "A2" ranges from 175 degrees to 180 degrees. The third portion 220 defines a third inner surface 222 (shown in FIG. 3) and a third outer surface 224. It should be noted that each of the first, second, and third inner surfaces 210, 216, 222 together define an inner surface of the end wall 154. Further, the first, second, and third outer surfaces 212, 218, 224 together define an outer surface of the end wall 154.

Further, the second portion 214 includes the perforations 196. The third portion 220 defines the fourth edge 202 of the end wall 154 that is connected to each of the first edge 172 of the first side wall 150 and the second edge 174 of the second side wall 152. Further, in the illustrated example, each of the first portion 208, the second portion 214, and the third portion 220 of the end wall 154 includes a substantially planar profile. The planar profile relates to the inner surfaces 210, 216, 222 and the outer surfaces 212, 218, 224 of the first, second, and third portions 208, 214, 220. More particularly, the inner surfaces 210, 216, 222 and the outer surfaces 212, 218, 224 of the first, second, and third portions 208, 214, 220 are embodied as flat surfaces. Each of the first portion 208, the second portion 214, and the third portion 220 is embodied as a substantially rectangular plate.

Further, the dragline bucket 102 may hold an amount of the material 157 in the material receiving portion 156. The amount of the material 157 held in the dragline bucket 102 may be adjudged by a struck capacity "Sc" of the dragline bucket 102 or a rated capacity "Rc" of the dragline bucket 102. The struck capacity "Sc" may be defined as an actual measured or calculated box volume of the dragline bucket 102. The struck capacity "Sc" may relate to a volume of the material receiving portion 156 between a first line "L1" and the end wall 154. Further, the rated capacity "Rc" may relate to a volume of the material receiving portion 156 between a second line "L2" and the end wall 154. When the material 157 is received within the material receiving portion 156, an angle of repose "A3" is defined by a heap of the material 157. The angle of repose "A3" may be defined as an angle formed by the material 157 proximate to the mouth portion 158. The angle of repose "A3" may be measured between the first line "L1" and the second line "L2".

Figure 5:
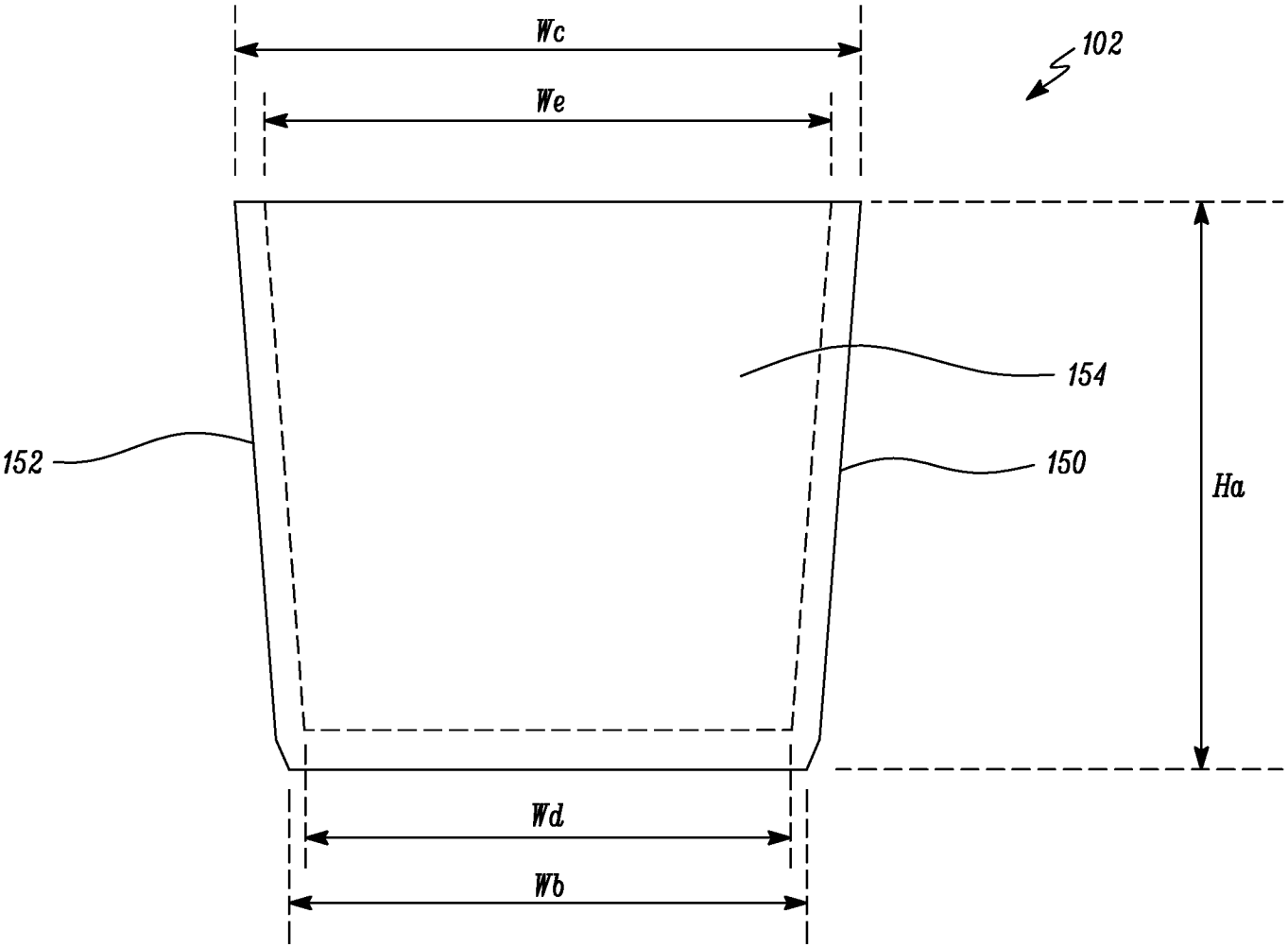
FIG. 5 illustrate a schematic view of the dragline bucket of FIG. 2.

FIG. 5 illustrates a schematic view of the dragline bucket 102. In FIG. 5, solid lines depict an area of the dragline bucket 102 proximate to the mouth portion 158 (see FIG. 3) whereas broken lines depict an area of the dragline bucket 102 proximate to the end wall 154. The struck capacity "Sc" (in cubic feet) of the dragline bucket 102 is calculated using following equation (1), $$Sc = \frac{Wa \times Ha \times L \times F}{1728} \qquad \text{Equation (1)}$$

In the equation (1), "Ha" is an average inside height of the dragline bucket 102, "L" (shown in FIG. 4) is a length between an edge of a cutting lip (not shown) and the end wall 154, and "F" is a corrective factor/form factor. It should be noted that the term "form factor" as referred to herein may be defined as a mathematical factor expressing a loss of the capacity of the dragline bucket 102 due to presence of various curvatures in the dragline bucket 102, such as the curvatures 176, 198 (see FIG. 3). Further, "Wa" is an average inside width of the dragline bucket 102. It should be noted that the average inside height "Ha", the length "L", and the average inside width "Wa" are measured in inches. The value of "Wa" is calculated using following equation (2), $$Wa = \frac{Wb + Wc + Wd + We}{4} \qquad \text{Equation (2)}$$

In the equation (2), "Wb" is an inside width of the base member 142 (see FIGS. 3 and 4) measured proximate to the fourth end 160 (see FIG. 3) of the base member 142, "Wd" is an inside width of the base member 142 measured proximate to the third end 148 (see FIGS. 3 and 4) of the base member 142, "We" is an inside width of the end wall 154 measured proximate to the fourth edge 202 (see FIG. 3), and "Wc" is an inside width between the first and second side walls 150, 152 proximate to the first and second edges 172, 174 (see FIG. 3) of the respective first and second side walls 150, 152. The inside width "Wc" is measured proximate to the mouth portion 158. Further, the rated capacity "Rc" (in cubic yards) of the dragline bucket 102 may be calculated using following equation (3), $$Rc = \frac{Sc \times 0.9}{27} \qquad \text{Equation (3)}$$

In the above equation (3), the factor "0.9" expresses a 10% loss of the struck capacity "Sc" due to the angle of repose "A3" (see FIG. 4). It should be noted that the dragline bucket 102 may be manufactured by any known manufacturing process generally known in the art. In some embodiments, the dragline bucket 102 may be made up of a material, such as, iron, steel, aluminum, or any other metal or alloy.

INDUSTRIAL APPLICABILITY

The present disclosure relates to the dragline bucket 102 that may be associated with a number of different machines. The dragline bucket 102 includes an improved design that may lead to an increase in the struck capacity "Sc" and therefore the rated capacity "Rc" of the dragline bucket 102. More particularly, the dragline bucket 102 includes the end wall 154 having an improved design. The end wall 154 includes a tight wall profile. The design of the first portion 208, the second portion 214, and the third portion 220 of the end wall 154 may collectively reduce the form factor "F" which may in turn increase the struck capacity "Sc" and the rated capacity "Rc" of the dragline bucket 102. In an example, a total volume deduction in the form factor "F" observed in the dragline bucket 102 described herein may be less than 3%. Further, in some examples, the design of the first portion 208, the second portion 214, and the third portion 220 may increase the total volume of the dragline bucket 102 by 2% to 10%, however, this value may vary based on a size of the dragline bucket 102. Further, the increase in the struck capacity "Sc" and the rated capacity "Rc" of the dragline bucket 102 may in turn increase a productivity of operations that employ the dragline bucket 102 described herein.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A dragline bucket comprising:

a base member defining a first end, a second end, and a third end;

a first side wall extending from the base member proximate to the first end of the base member, the first side wall defining a first edge that is distal to the base member;

a second side wall extending from the base member proximate to the second end of the base member, wherein the first side wall is laterally spaced apart from the second side wall, the second side wall defining a second edge that is distal to the base member; and an end wall extending from the base member proximate to the third end of the base member such that the end wall is connected to each of the first side wall and the second side wall, wherein the base member, the first side wall, the second side wall, and the end wall define a material receiving portion of the dragline bucket, the end wall including:

a first portion connected to the base member, wherein the first portion is disposed such that a first angle is defined between the base member and the first portion, wherein the first angle ranges from 130 degrees to 170 degrees;

a second portion extending from the first portion, wherein the second portion is substantially perpendicular to the base member; and a third portion extending from the second portion such that the second portion is disposed between the first portion and the third portion, wherein the third portion is disposed such that a second angle is defined between the second portion and the third portion, wherein the second angle ranges from 170 degrees to 180 degrees.

2. The dragline bucket of claim 1, wherein each of the first portion, the second portion, and the third portion of the end wall includes a substantially planar profile.

3. The dragline bucket of claim 1, wherein each of the first side wall, the second side wall, and the end wall defines a plurality of perforations.

4. The dragline bucket of claim 1, wherein the first angle ranges from 140 degrees to 150 degrees.

5. The dragline bucket of claim 1, wherein the second angle ranges from 175 degrees to 180 degrees.

6. The dragline bucket of claim 1, wherein the dragline bucket defines a first height and the second portion defines a second height such that the second height is approximately equal to 20% to 55% of the first height.

7. The dragline bucket of claim 1, wherein the first side wall, the second side wall, and the base member define a mouth portion for receiving material in the material receiving portion.

8. The dragline bucket of claim 1, wherein the end wall defines a third edge proximate to the base member and a fourth edge distal to the base member.

9. The dragline bucket of claim 8, wherein the fourth edge is connected to each of the first edge of the first side wall and the second edge of the second side wall.

10. The dragline bucket of claim 1, wherein each of the first side wall and the second side wall includes a trunnion attachment structure disposed proximate to the end wall.

11. The dragline bucket of claim 1, further comprising:

a first curvature between the first side wall and the base member; and a second curvature between the second side wall and the base member.

12. The dragline bucket of claim 1, further comprising:

a third curvature between the first side wall and the end wall; and a fourth curvature between the second side wall and the end wall.

13. A machine comprising:

a boom;

a rigging assembly adapted to be coupled to the boom; and a dragline bucket adapted to be coupled to the rigging assembly, the dragline bucket including:

a base member defining a first end, a second end, and a third end;

a first side wall extending from the base member proximate to the first end of the base member, the first side wall defining a first edge that is distal to the base member;

a second side wall extending from the base member proximate to the second end of the base member, wherein the first side wall is laterally spaced apart from the second side wall, the second side wall defining a second edge that is distal to the base member; and an end wall extending from the base member proximate to the third end of the base member such that the end wall is connected to each of the first side wall and the second side wall, wherein the base member, the first side wall, the second side wall, and the end wall define a material receiving portion of the dragline bucket, the end wall including:

a first portion connected to the base member, wherein the first portion is disposed such that a first angle is defined between the first portion and the base member, wherein the first angle ranges from 130 degrees to 170 degrees;

a second portion extending from the first portion, wherein the second portion is substantially perpendicular to the base member; and a third portion extending from the second portion such that the second portion is disposed between the first portion and the third portion, wherein the third portion is disposed such that a second angle is defined between the second portion and the third portion, wherein the second angle ranges from 170 degrees to 180 degrees.

14. The machine of claim 13, wherein each of the first portion, the second portion, and the third portion of the end wall includes a substantially planar profile.

15. The machine of claim 13, wherein each of the first side wall, the second side wall, and the end wall defines a plurality of perforations.

16. The machine of claim 13, wherein the first angle ranges from 140 degrees to 150 degrees.

17. The machine of claim 13, wherein the second angle ranges from 175 degrees to 180 degrees.

18. The machine of claim 13, wherein the dragline bucket defines a first height and the second portion defines a second height such that the second height is approximately equal to 20% to 55% of the first height.

19. The machine of claim 13, wherein the first side wall, the second side wall, and the base member define a mouth portion for receiving material in the material receiving portion.

20. The machine of claim 13, wherein the end wall defines a third edge proximate to the base member and a fourth edge distal to the base member.

21. The machine of claim 20, wherein the fourth edge is connected to each of the first edge of the first side wall and the second edge of the second side wall.

22. The machine of claim 13, wherein each of the first side wall and the second side wall includes a trunnion attachment structure disposed proximate to the end wall, wherein the trunnion attachment structure is adapted to be coupled with a portion of the rigging assembly.

23. The machine of claim 13, further comprising:

a first curvature between the first side wall and the base member; and a second curvature between the second side wall and the base member.

24. The machine of claim 13, further comprising:

a third curvature between the first side wall and the end wall; and a fourth curvature between the second side wall and the end wall.

* * * * *